US010954574B2

(12) United States Patent
MacRae et al.

(10) Patent No.: US 10,954,574 B2
(45) **Date of Patent: *Mar. 23, 2021**

(54) WATER PIPE COLLECTION BOX AND STAVE COOLER SUPPORT

(71) Applicants: MacRae Technologies, Inc., Hayward, CA (US); CECAL Indústria e Comércio Ltda., Lorena (BR)

(72) Inventors: Allan J. MacRae, Hayward, CA (US); Carlo Geronimi, Sao Palo (BR)

( * ) Notice: Subject to any disclaimer, the term of this patent is extended or adjusted under 35 U.S.C. 154(b) by 0 days.

This patent is subject to a terminal disclaimer.

(21) Appl. No.: 16/290,922

(22) Filed: Mar. 3, 2019

(65) Prior Publication Data

US 2019/0271049 A1 Sep. 5, 2019

Related U.S. Application Data

(63) Continuation-in-part of application No. 13/148,003, filed on Dec. 23, 2011, now Pat. No. 10,247,477, and (Continued)

(51) Int. Cl.
*F27D 1/00* (2006.01)
*F27B 1/14* (2006.01)
(Continued)

(52) U.S. Cl.
CPC ..... *C21B 7/10* (2013.01); *F27D 1/12* (2013.01); *F27D 2009/0062* (2013.01)

(58) Field of Classification Search
CPC .... F27D 1/12; F27D 1/004; F27D 2009/0062; C21B 7/10
See application file for complete search history.

(56) References Cited

U.S. PATENT DOCUMENTS 2,319,065 A 5/1943 Karmanocky
2,345,188 A 3/1944 Foell
(Continued)

FOREIGN PATENT DOCUMENTS

DE 2934453 A1 3/1981
EP 0025132 A1 3/1981
(Continued)

OTHER PUBLICATIONS

Joubert Analysis of Blast Furnace Lining/Cooling Systems Using Computational Fluid Dynamics by Hugo Joubert, A Thesis at the Rand Afrikaans University, Nov. 1997 (herein Joubert).
(Continued)

*Primary Examiner* — Scott R Kastler
(74) *Attorney, Agent, or Firm* — Main Law Cafe; Richard Brewster Main

(57) ABSTRACT

A water pipe collection box and stave support for a cast copper stave cooler body panel that has disposed within it a circuit of water pipes with a number of loops each with an inlet end and an outlet end, and all such inlet ends and outlet ends clustered together in a single group that exits a backside of the copper stave cooler body panel. A cast copper stave cooler body panel that has disposed within a circuit of water pipes with a number of loops each with an inlet end and an outlet end, and all such inlet ends and outlet ends clustered together in a single group that exits a backside of the copper stave cooler body panel. A blast furnace having stave cooler body panels variously profiled to fit inside, and where each has disposed within it a circuit of water pipes with a number of loops each with an inlet end and an outlet end, and all such inlet ends and outlet ends are clustered together in a single group that exits a backside of each copper stave cooler body panel.

13 Claims, 10 Drawing Sheets

Related U.S. Application Data a continuation-in-part of application No. 16/101,418, filed on Aug. 11, 2018, now Pat. No. 10,364,475, which is a continuation-in-part of application No. 15/815,343, filed on Nov. 16, 2017, now Pat. No. 9,963,754, application No. 16/290,922, which is a continuation-in-part of application No. 13/147,996, filed as application No. PCT/US2011/030591 on Mar. 30, 2011.

(60) Provisional application No. 62/808,857, filed on Feb. 22, 2019, provisional application No. 62/701,832, filed on Jul. 22, 2018, provisional application No. 61/318,977, filed on Mar. 30, 2010, provisional application No. 61/319,089, filed on Mar. 30, 2010.

(51) Int. Cl.

| | |
|---|---|
| ***C21B 7/10*** | (2006.01) |
| ***F27D 1/12*** | (2006.01) |
| *F27D 9/00* | (2006.01) |

(56) References Cited

U.S. PATENT DOCUMENTS

| | | | | |
|---|---|---|---|---|
| 4,768,447 | A | 9/1988 | Roumeguere | |
| 4,809,621 | A | 5/1989 | Materna | |
| 5,426,664 | A | 6/1995 | Grove | |
| 6,126,893 | A | 10/2000 | Otsuka | |
| 6,280,681 | B1 | 8/2001 | MacRae | |
| 8,834,784 | B2 | 9/2014 | MacRae | |
| 9,963,754 | B2 * | 5/2018 | MacRae | F28F 21/082 |
| 10,222,124 | B2 * | 3/2019 | Smith | C21B 7/10 |
| 2012/0104670 | A1 | 5/2012 | Smith | |
| 2012/0193843 | A1 | 8/2012 | MacRae | |
| 2013/0203007 | A1 | 8/2013 | Smith | |
| 2015/0377554 | A1 | 12/2015 | Smith | |
| 2018/0149429 | A1 | 5/2018 | Smith | |
| 2019/0154338 | A1 | 5/2019 | Smith | |

FOREIGN PATENT DOCUMENTS

| | | | | |
|---|---|---|---|---|
| GB | 148611 | | 9/1977 | |
| WO | 2011/123579 | A1 | 10/2010 | |
| WO | 2011123568 | | 9/2012 | |
| WO | WO-2014121213 | A2 * | 8/2014 | C21B 7/10 |
| WO | 2014121213 | | 8/2015 | |

OTHER PUBLICATIONS

METEC2011 White Paper delivered Jun. 30, 2011, in Dusseldorf, Germany, by Todd G. Smith and Allan J. Macrae, Authors. Titled "New Method of Lining a Blast Furnace".

* cited by examiner

Tuyers and Hearth below not Shown 206, 208, 214
204
204
202
outside-the-shell adapter plate 216
206-216
gas-tight to furnace shell
couplers 214
thimble cover plate 212
206-214
pipe box 210
thimble sleeves 208
pipe inlet and outlet ends 206
404
404
406
404
200
up
202
stave cooler 108

216
furnace shell 114
212
steel pipe "stuffing" box 210
406
406 stuffing
pipe couplings 214
404
206
finished stave casting 200, 402, 206, 202
pipe inlet/outlets embedded in copper casting
warping corner control seat boss 404 typ of 4
helicoil
exposed face after flush casting
cast-in steel frame 202
202 cast-in steel frame
206
cast-in nickel-alloy pipe circuit 402
404
copper stave panel 200
404
400 shotcrete up 511a 510a
513a 512a
513b 512b
511b 510b
common
opening
516
weld
515
500 stave cooler
502 metal panel
514
520
522
brick
524
horizontal ribs
and grooves
in hot-face
504
furnace steel
containment
shell
508, 510-513
pipe circuit and
loops of cooling pipe lower brick rows are preferably installed previous to the current brick row, but not necessarily. Any brick can be replaced later without affecting adjacent ones.

WATER PIPE COLLECTION BOX AND STAVE COOLER SUPPORT

CROSS-REFERENCE TO RELATED APPLICATIONS

This application Ser. No., 16/290,922, Claims priority from provisional application, 62/808,857, filed Feb. 22, 2019, now expired. This application Ser. No., 16/290,922, is a Continuation in-part of application Ser. No. 16/101,418, filed Aug. 11, 2018, now U.S. Pat. No. 10,364,475. application Ser. No. 16/101,418 is a Continuation in-part of application Ser. No. 15/815,343, filed Nov. 16, 2017, now U.S. Pat. No. 9,963,754; and claims priority from a provisional application, 62/701,832, filed Jul. 22, 2018, now expired. This application Ser. No., 16/290,922, is a Continuation in-part of application Ser. No., 13/147,996, filed Dec. 23, 2011, now abandoned. application Ser. No., 13/147,996, is a National Stage Entry of PCT/US11/30591, filed Mar. 30, 2011. PCT/US11/30591 Claims priority from a provisional application 61/318,977, filed Mar. 30, 2010, now expired. This application Ser. No., 16/290,922, is a Continuation in-part of application Ser. No. 13/148,003, filed Dec. 23, 2011, now U.S. Pat. No. 10,247,477. application Ser. No. 13/148,003 Claims priority from provisional application 61/319,089, filed Mar. 30, 2010, now expired.

FIELD OF INVENTION

Embodiments of the present invention relate to blast furnaces, the stave coolers used inside them, and the hardware used to mount these stave coolers and connect and circulate coolants. More particularly, embodiments of the present invention embed a steel footer/anchor ring in a stave copper casting that is gas-tight and mechanically locked in by exotic dissimilar metal welding, and/or by entrained liquid copper that passed through and froze inside openings preformed in the steel footer rings. A pipe collection box of carbon steel is welded on afterwards that is strong enough to support the full weight of the stave and gas-tight to contain lethal process gases associated with blast furnaces.

BACKGROUND

Purpose of water-cooled components like stave coolers in blast furnaces is to arrest erosion/corrosion of the refractory lining, e.g., to establish a stable blast furnace crucible. Water-cooled components enable stable openings for passage of process constituents into or out of the blast furnace. For example, Tuyeres.

Back as early as June 2011, Todd G. Smith and Allan J. MacRae jointly invented a "Can" on a steel backing plate they used to support cast copper stave coolers inside blast furnaces. The advantage of the Can was all the pipe circuit inlet ends and outlet ends were clustered together inside the Can for exit outside in one group per stave.

Even years earlier, in 1980, Mashinenfabrik Ausberg-Nurenberg (MAN) of Oberhausen, Germany had built a plate cooler in which a large diameter bulkhead coupler was threaded into the the cooler's backside and it too had all its pipe circuit inlet ends and outlet ends clustered together inside what they labeled a "Befestigunggstutzen" for exit outside the blast furnace in one group per stave. Both were concerned with keeping dangerous lethal process gases sealed up inside the blast furnace containment shell. The cast-into-copper "can" depended on good copper-steel bonds and steel-to-steel welds, the "Befestigunggstutzen" needed heavy duty specialized gas-sealing washers and large strong locknuts.

We discussed the challenges and techniques of gas sealing blast furnace stave coolers in a parent to this application that was published as US Published Patent Application US2013-0203007 on Aug. 8, 2013.

What is needed now is a closed Can that can be attached well enough to the backside of a cast copper stave cooler that it will not pull off after several years of service and that will continue to contain lethal process gases inside for its entire campaign life. All the while supporting the 3,000+ kg weight of a ten foot tall all-copper stave cooler inside the blast furnace shell.

SUMMARY OF THE DRAWINGS

FIG. 2A represents this assembly in exploded assembly view, and shows a thimble cover plate that slips over the several thimble sleeves installed on the water pipe inlet and outlet ends. The thimble cover plate is welded to the pipe box and all the thimble sleeves for a gas-tight containment of lethal processes gases that snake around behind the stave. The distal ends of the water pipe inlet and outlet ends are fitted with pipe couplers;

FIGS. 2A-2D do not show any material that may be stuffed inside the pipe box before it is sealed up;

DETAILED DESCRIPTION OF THE PREFERRED EMBODIMENTS

Figure 1:
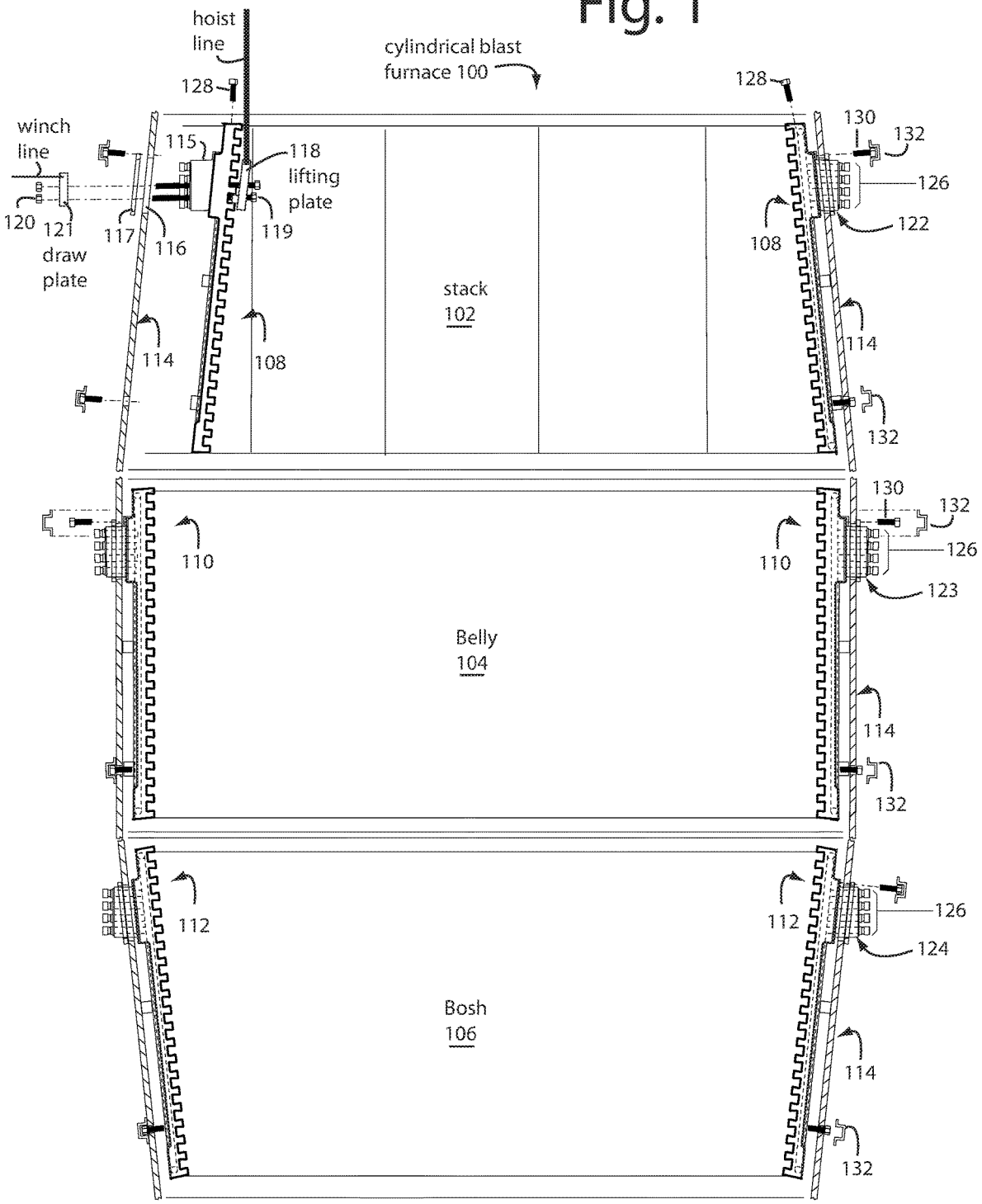
FIG. 1 is a cross sectional view diagram of an upright cylindrical blast furnace in an embodiment of the present invention. Stave coolers are used throughout, but FIG. 1 is intended to show that at least three horizontally curved and trapezoidal variations of the stave coolers are needed to better fit the inside contours of the blast furnace.

FIG. 1 represents a blast furnace (BF) 100 in an embodiment of the present invention. BF 100 is vertically cylindrical, with at least three zones, a stack 102 that narrows in diameter at the top, a Belly 104 with essentially vertical walls, and a Bosh 106. Not shown are the Tuyere level and the hearth beneath. So BF 100 here comprises three types of stave coolers, 108, 110, and 112, generally in panels ten feet tall, about forty inches wide, and six inches thick. All have a slight horizontal curvature in them to allow a better fit inside the cylindrical walls.

Stave coolers 108 are about forty inches wide at the top and about forty three inches wide at the bottom to accommodate the cone effect of the stack 102 narrowing in diameter at the top. Stave coolers 110 are about forty three inches wide top and bottom because the top and bottom diameters of Belly 104 are about the same. Stave coolers 112 are about forty three inches wide at the top and about forty inches wide at the bottom to accommodate the inverse cone effect of the Bosh narrowing in diameter at the bottom.

A single blast furnace shell 114 typically made of two inch carbon steel plate, and provides an outermost blast furnace containment. Its walls and penetrations 115 provide the necessary support on which to hang every stave cooler 108, 110, and 112. The penetrations 115 can be cut onsite from the outside with a gas torch. If access to the inside is possible, the job of cutting penetrations 115 is much easier.

Each stave cooler can typically weigh 3,000 kg, principally consisting of very pure copper casting and associated piping and fittings. Such weight is almost entirely supported by a steel water pipe collection box and stave cooler support (hereinafter, "pipe box") 116 that protrudes from the backside of each stave cooler 108, 110, and 112.

In the top left corner of FIG. 1, a stave cooler 108 is shown in the process of being lifted and installed inside blast furnace shell 114. The object is to lift stave cooler 108 and insert a pipe box 115 through a penetration 116. An adapter plate 117 can then be welded on to secure stave 108 in place. The job of installation is made much easier if a steel lifting plate 118 is attached to a hoist line and is fastened to the hotface of stave cooler 108 using two very long threaded rods or hex-head machine bolts 119. It helps if lifting plate 118 has a horizontal rib that can key into the horizontal ribs and lock on the hotface of stave cooler 108.

These two bolts 119 are long enough to be run completely through pipe box 115 and to be fastened with nuts 120 to a winch line draw plate 121. Such lifting plate 118, bolts 119, nuts 120, and winch line draw plate 121 should already be assembled when the stave cooler 108 is lifted up and dangling on the hoist line. The winch line can be slipped through penetration 116 to draw it out and into place for welding.

All such pieces are reusable, except bolts 119 which get punched in from the outside (after removing nuts 120 and draw plate 121) to fall down to the bottom on the inside. The holes left behind are then plugged up or otherwise filled from the outside. The bolt holes left behind could also be used for thermocouples and wear monitor probes with appropriate packing and sealing.

Since stave coolers 108, 110, and 112 do not all hang the same vertically inside BF 100, their respective pipe boxes 115 must be set at a different angle for each such that all the plumbing exiting from them will be level after installation in the shell 114. Therefore, three variations of pipe box 115 are needed, stave coolers 108 require a pipe box 122, stave coolers 110 require a pipe box 123, and stave coolers 112 require a pipe box 124.

A number of independent loops of MONEL-400, for example, water pipe are cast into every stave cooler 108, 110, and 112. Other embodiments may use copper-nickel instead of MONEL-400. A single group 126 of water inlets and outlets connected internally are routed horizontally out through each respective pipe box 122, 122, and 124. MONEL-400 and copper-nickel water pipe are used instead of ordinary copper tubing in some embodiments because such bonds better to the copper casting being poured and the hot liquid copper will not "burn through" during casting.

A temporary lifting bolt 128 can be fitted into each stave cooler 108, 110, and 112 during installation inside of and on shell 114, e.g., to lift it so lifting plate 118 and bolts 119 can be installed and attached to the hoist line. After it's no longer needed, it can be removed and the inside threaded area plugged. A set of four slip bolts 130 is installed for each stave cooler 108, 110, and 112 from outside shell 114. The four slip bolts 130 are not needed so much to support the weight of each stave cooler 108, 110, and 112 inside shell 114, but are used to hold the stave cooler up against the blast furnace shell. The four slip bolts 130 need to be snug, but should allow for some slippage as will be needed when the stave cooler naturally expands and contracts. Special washers inside or outside, or both, may help this functioning. Once bolts 130 are installed from outside shell 114, a gas-tight cup 132 is welded over the head of each on the outside of shell 114. Lethal carbon monoxide (CO) process gases can leak past otherwise.

Figures 2A, 2B, 2C, 2D:
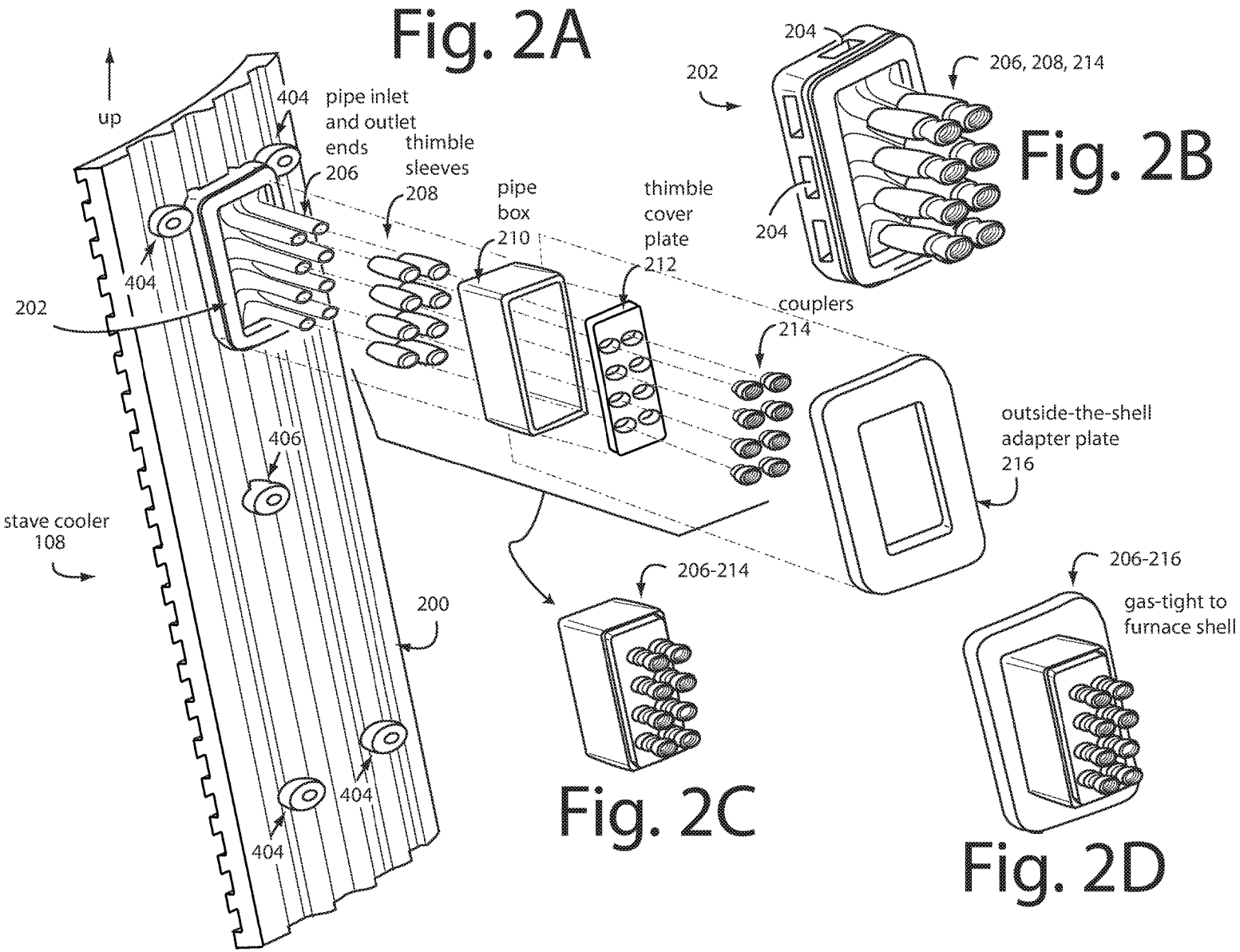
FIG. 2A is an above and left perspective view diagram of a representative stave cooler from the blast furnace of FIG. 1 in an embodiment of the present invention. The stave cooler is shown as it comes finished from copper casting with a steel, perforated frame anchor copper-steel welded and/or copper entrained and embedded flush in the copper casting. Bare water pipe inlet and outlet ends are exposed. These need to be sleeved in gas-tight thimbles and enclosed in a pipe box.
FIG. 2B is a diagram for illustration purposes only of how the perforated frame anchor opens up to pass all the water pipe inlet and outlet ends. Alternative ways of anchoring are obvious. It further shows the thimble sleeves and couplers in place without showing the pipe box, stave casting, and thimble cover plate that would make this view impossible.
FIG. 2C more realistically shows the several water pipe inlet and outlet ends in one group and gas-tight enclosed within the pipe box and thimble cover plate and finished with thimble sleeves and pipe couplers.
FIG. 2D is an outside perspective view diagram of the part of the assembly of FIG. 2C that is exposed and visible outside the blast furnace shell (without showing the shell), and with an outside-the-shell adapter plate that is welded to both the blast furnace shell and the assembly of FIG. 2C. Such weld is also gas-tight and sufficient to enable the pipe box to support the entire weight of the stave cooler inside the blast furnace shell.

FIG. 2A represents a typical stave cooler from BF 100 as it comes finished from copper casting with a steel, perforated frame anchor 202 copper-steel welded and/or copper entrained in openings 204 and embedded flush in a copper casting 200. Alternatively, perforated frame anchor 202 can be made of stainless steel or nickel alloy. Alternatively, 204 may be tabs or protrusions that get themselves locked inside the cast metal. The backside is shown scalped of material to lighten the stave and reduce costs, that may not always work well. In some applications this can be important, e.g., to save money on the copper.

Bare water pipe inlet and outlet ends 206 are exposed. In this embodiment, these are sleeved in gas-tight thimbles 208 and enclosed in a pipe box 210. It is possible to not use sleeves at all. FIG. 2A shows a thimble cover plate 212 that slips over the several thimble sleeves and installs over the water pipe inlet and outlet ends 206. The thimble cover plate 212 is perimeter welded in the factory to the pipe box 210, and welded all around each and all of the thimble sleeves 208 for a gas-tight containment of lethal processes gases that snake around behind stave 108 and into pipe box 210. The several distal ends of the water pipe inlet and outlet ends 206 are here fitted with pipe couplers 214.

Many other obvious ways exist to bring the water pipe inlet and outlet ends 206 out of pipe box 210 and fit them with pipe couplers 214. The point is to keep process gases contained inside while enabling the coolant plumbing connections outside. So the pipe ends themselves or the couplers can be welded to the thimble cover plate 212 when there is no sleeving. The piping includes 2" diameter NPT components in this embodiment.

FIG. 2B is for illustration purposes only. The perforated frame anchor 202 is open in the middle to pass through all the water pipe inlet and outlet ends 206. The thimble sleeves 208 and couplers 214 are seen in place without showing the pipe box, stave casting, and thimble cover plate that would make this view impossible.

FIG. 2C is more realistic. Several water pipe inlet and outlet ends 206 are gathered in one group, and gas-tight enclosed within the pipe box 210 and thimble cover plate 212. Outside, it can be finished, e.g., with thimble sleeves and pipe couplers for hose connections.

FIG. 2D is an outside perspective view diagram of the part of the assembly of FIG. 2C that is exposed and visible outside the blast furnace shell (without showing the shell), and with an outside-the-shell adapter plate that is welded to both the blast furnace shell and the assembly of FIG. 2C. Such weld is also gas-tight and sufficient to enable the pipe box to support the entire weight of the stave cooler inside the blast furnace shell.

A flexible, thermally conductive material suitable for elevated temperature service may be stuffed inside pipe box 210 before it is sealed up. FIGS. 2A-2D do not show any. Such thermally conductive stuffing material enables a circulating coolant in the several water pipe inlet and outlet ends 206 to conduct away heat that would otherwise build up in the steel material enclosure of the pipe box assembly 210, 212.

Inside, not shown, this particular embodiment has four independent loops of MONEL-400 2" Schedule-40 pipe that are cast inside copper stave casting body panel 200, together they constitute a pipe circuit. The only parts of that visible in FIGS. 2A, 2B are the four inlet and four outlet pipe ends 206. In one embodiment, these were fitted with 2" AISI 304 pipe couplings and ASTM A-53 pipe sleeves.

It is important to gather the inlet and outlet pipe ends 126 closely together into one group per stave. Their common exit through the blast furnace shell 114 can then be "protected" by the one pipe box (120,122,124) from venting dangerous lethal process gases and from the mechanical and thermal stresses associated with having to support the 3,000+ kg weight of an installed stave cooler. Here, in this embodiment, the pipe boxes are made of ASTM A-36 carbon steel, but structural steel, or boiler plate steel are also possible.

Embodiments of the present invention do not cast the pipe boxes into the copper stave casting body panel 200. We ourselves tried doing that with unsatisfactory results. Carbon steel components do not bond well to the copper using conventional methods and can pull out and apart in service. For example, see the "manifold 106" in U.S. Pat. No. 10,222,124, issued Mar. 5, 2019. Steel components do not seal well in gas tight connections to the copper using conventional methods and lethal process gases can leak through the copper made porous at the interface while in service. The molten liquid copper during the casting pour cannot be pushed to well-up high enough inside.

As used herein, the terms "pipe collection box," collar, or pipe box (120,122,124) are terms that are equivalent to "manifold" and "external manifold."

A sufficiently strong "manifold" must have the copper casting well up high inside to add the strength needed to support the full weight of the stave cooler.

What makes pushing up the molten copper to well up high inside the "manifold" a bad idea is a so-called shrink-back. The extra thick copper welling up creates hot spots that shrink with cooling so much that the copper will pull off the steel inside.

Supports made of steel can be mechanically locked in by exotic dissimilar metal welding, and/or by entrained liquid copper that passed through and froze inside openings preformed in the steel footer rings.

Figure 3A:
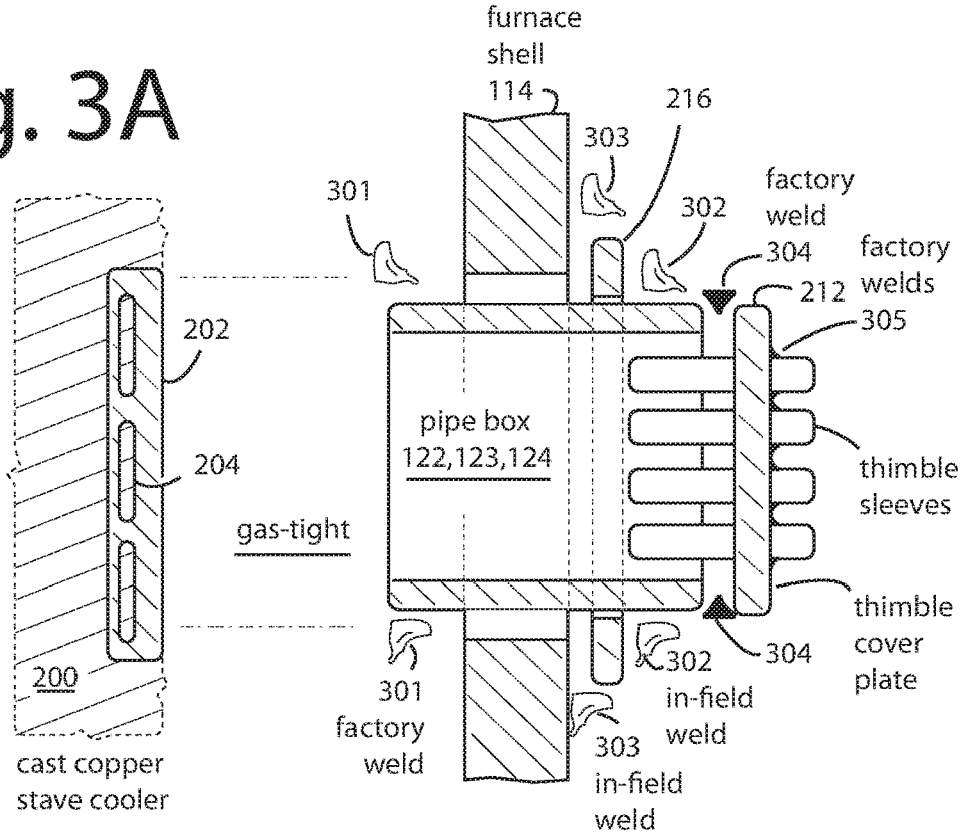
FIGS. 3A and 3B are a cross-sectional view diagram and a perspective diagram that illustrate there is an order and sequence to how the pipe box is welded to the already embedded steel perforated frame anchor after being frozen inside flush of the copper casting and/or welded in place. The pipe inlet and outlet ends are not shown for illustration clarity of the assembles that are shown.
Figure 3B:
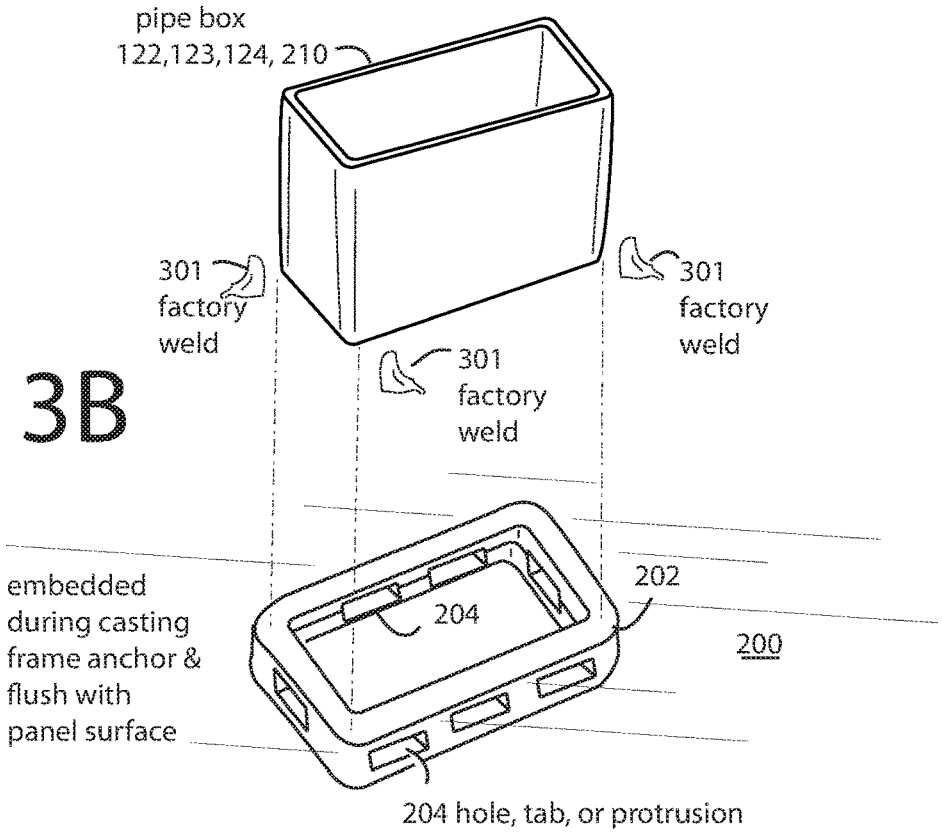

As represented in FIGS. 3A and 3B, embodiments of the present invention cast a structural steel, or boiler plate steel, footing and foundation frame 202 flush inside the copper stave casting body panel 200. Frame 202 surrounds the inlet and outlet pipe ends 126 like a low collar, but only to the surface level of the copper stave casting body panel 200. After casting is complete, the bottom edge of the appropriate steel pipe box 122, 123, 124 is welded in a factory weld 301 to the exposed top face of the steel footing and foundation frame 202. Pipes boxes can easily be 18" tall and 9" wide, hollow inside, and weigh forty-one kg. The welding 301 must be continuous and gas-tight, and the technology to do this is widely available, conventional, and practical to finish in the field.

Extraordinary measures are required to be sure the steel footing and foundation frame 202 stays strong and does not ever separate from the copper stave casting body panel 200. Exotic welding methods must be applied to weld steel to copper. Currently, this can only be done by specially equipped and advanced stave foundries. No practical field method or equipment is available.

Mechanical anchoring methods are used herein to lock the carbon steel footing and foundation frame 202 in place within the copper stave casting body panel 200. Openings 204 are placed in the bottom half of the footing and foundation frame 202 such that fingers of molten copper can flow in and freeze during casting to lock the parts together. No bonding of metals is relied upon by this alternative technology, and so the quality of any bonding achieved need not be all that good. Advantageously, the pipe boxes are excluded from the casting processes, and so are not underfoot.

During construction of BF 100, and the installation of any of stave coolers 108, 110, and 112, the job of hanging each inside in its place is highly simplified by the use of only one pipe box 122, 123, 124. Conventional staves often had four inlets widely separated from their corresponding four outlets wherein each was shielded by its own "protection pipe". Work crews find it much easier while maneuvering the heavy stave cooler to thread through the single pipe box in the blast furnace shell 114.

The stave coolers are lifted up inside blast furnace shell 114 and maneuvered to insert its corresponding pipe box 122, 123, 124 through an appropriate matching penetration. An adapter ring 216 is slipped over and a in-field weld 302 applied. Then a, in-field weld 303. A thimbled cover plate 212 with thimble sleeves is slipped over inlet/outlet pipe ends and welded at the factory with a weld 304 and a weld 305. All welds 301-305 must be continuous and gas-tight in order to contain lethal process gases inside pipe box 122, 123, 124. Fortunately, all welds are simplified by being carbon steel to carbon steel, and so those applied in the field can succeed with conventional equipment.

Returning to FIG. 2, the carbon steel footing and foundation frame 202 is always embedded by casting or solid state welding within the copper casting 200 before it is welded to pipe box 122, 123, 124. FIG. 2 has a duplicate footing and foundation frame 202 shown outside the casting 200 and already welded to the pipe box 122, 123, 124. This is shown here this way for illustration only purposes.

The steel footing and foundation frame 202, and a matching pipe box, could be in the form of a ring and a cylinder in order to facilitate friction welding by spinning carbon steel footing and foundation frame 202 under pressure into the casting 200.

The point is to show openings 204 for copper finger entraining exist all around the bottom lower perimeter of footing and foundation frame 202.

Once each stave cooler 108, 110, and 112 is raised and hung inside shell 114, and its pipe box 122, 123, 124 is pushed all the way through, an adapter plate 210 is slipped over outside and welded on all around for a gas-tight seal. The inside opening dimensions of adapter plate 210 can be tightly controlled economically. More so than trying to get the pipe box penetrations in shell 114 to locate and fit concisely. The adapter plate 210 is a crutch to make installation easier, the pipe boxes themselves can, of course, be directly welded to the pipe box penetrations in shell 114, given the gaps all around are not too wide.

Since each stave cooler 108, 110, and 112 here is made from cast copper, its hot-face will wear rapidly in service if not provided with a protection barrier, layer or liner. Ordinarily this will be common refractory brick walls erected as the inner liners of BF 100 and cooled by stave coolers 108, 110, and 112. Bricks can require some sort of horizontal ribs and grooves with which the bricks can be inserted and retained for a twenty year campaign life.

Stave coolers made of copper need to have a wear resistant barrier installed on their hotfaces. For example, horizontal rows of refractory bricks made of silicon carbide or graphite can be stacked in front of or inserted by various means into an appropriately contoured hotface. The key benefits of StarCeram® S Sintered Silicon Carbide (SSiC) are advertised commercially to include excellent chemical resistance, very high strength, corrosion resistance up to very high application temperatures, excellent mechanical high temperature properties, very good thermal shock resistance, low thermal expansion, very high thermal conductivity, high wear resistance, very high hardness, semiconductor properties. All good things for a stave cooler in a blast furnace.

Simple "bricks" or blocks of cast iron are also expected to function well.

An alternative to bricks is any refractory or shotcrete, which is similar to gunite and is a refractory that is blown onto the hotfaces of stave coolers through high pressure concrete hoses and nozzles. Minerals Technologies Inc. (MiNTEQ) of Bethlehem, Pa., is a commercial producer of shotcrete for blast furnaces. Its rapid installation rates bring down costs and total refractory installation time, they are low-rebound and reduce total consumption, and they are superior refractoriness that increase blast furnace life, and improve fuel efficiency.

A variety of SUPERSHOT™ products are sold worldwide for Blast furnace operations. SUPERSHOT™ AR material suits mid-stack to upper-stack re-linings and repairs. It has excellent abrasion resistance at lower temperatures. Sixty percent alumina silica, low cement bonded shotcrete. Such does not require high-firing temperatures to develop its physical properties and abrasion resistance. SUPERSHOT™ SC15 is 72% alumina silica, 15% silicon carbine with ultra-low cement binder. It is high density, high thermal conductivity, low porosity shotcrete capable of rapid dry out. SUPERSHOT™ BL shotcrete material is suited for the thermal protection of Belly Linings during blow-in. The same shotcrete equipment can be used, with no change over to gunning material and batch guns. Rapid installation rates of over eight tons/hour are possible.

FIGS. 3A and 3B are a cross-sectional view diagram and a perspective diagram that illustrate there is an order and sequence to how the pipe box is welded to the already embedded steel perforated frame anchor after being frozen inside flush of the copper casting and/or welded in place. The pipe inlet and outlet ends are not shown for illustration clarity of the assembles that are shown.

Figures 4A, 4B:
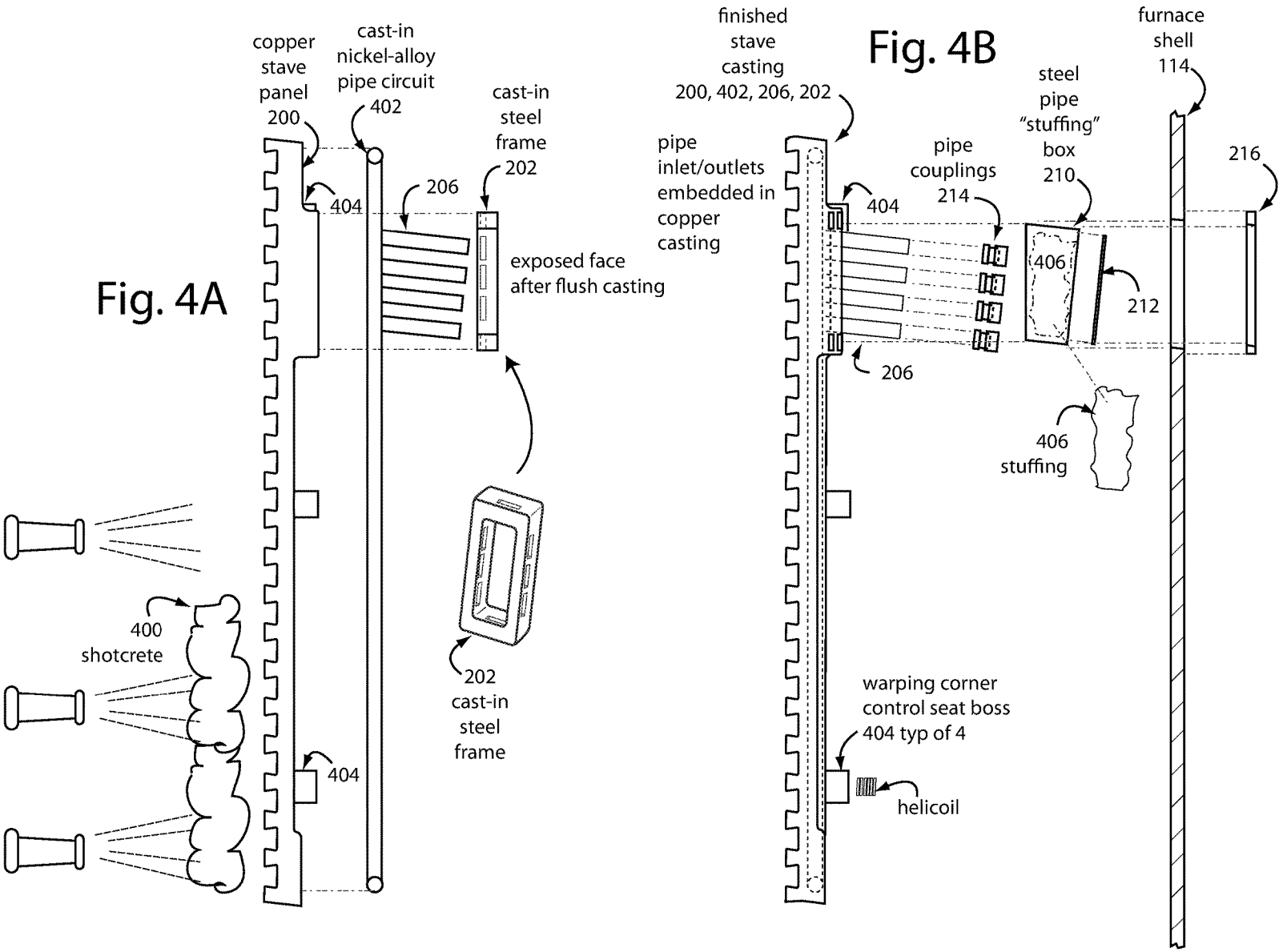
FIG. 4A is a cross sectional view diagram of a stave cooler embodiment of the present invention in exploded assembly view before copper casting, such stave cooler is similar to those of FIGS. 1 and 2A, except that the hotface here has been horizontally grooved to retain shotcrete blown on through hoses and nozzles. Here are represented the copper casting of the stave itself, the pipe circuit that goes into the casting, and the perforated frame anchor that also goes into the casting and that is left with an exposed face after being set flush in the casting.
FIG. 4B is a cross sectional view diagram of a finished stave casting of FIG. 4A.

FIG. 4A represents a stave cooler 108 in an embodiment of the present invention before copper casting, such stave cooler is similar to those of FIGS. 1 and 2A, except that the hotface here has been horizontally grooved to retain a shotcrete 400 blown on through hoses and nozzles. Here are represented a copper casting 200 of the stave itself, a pipe circuit 402 that goes into the casting 200, and the perforated frame anchor 202 that also goes into the casting 200 and that is left with an exposed face 403 after being set flush in the casting.

FIG. 4B shows the finished stave casting 108 of FIG. 4A.

Figure 4C:
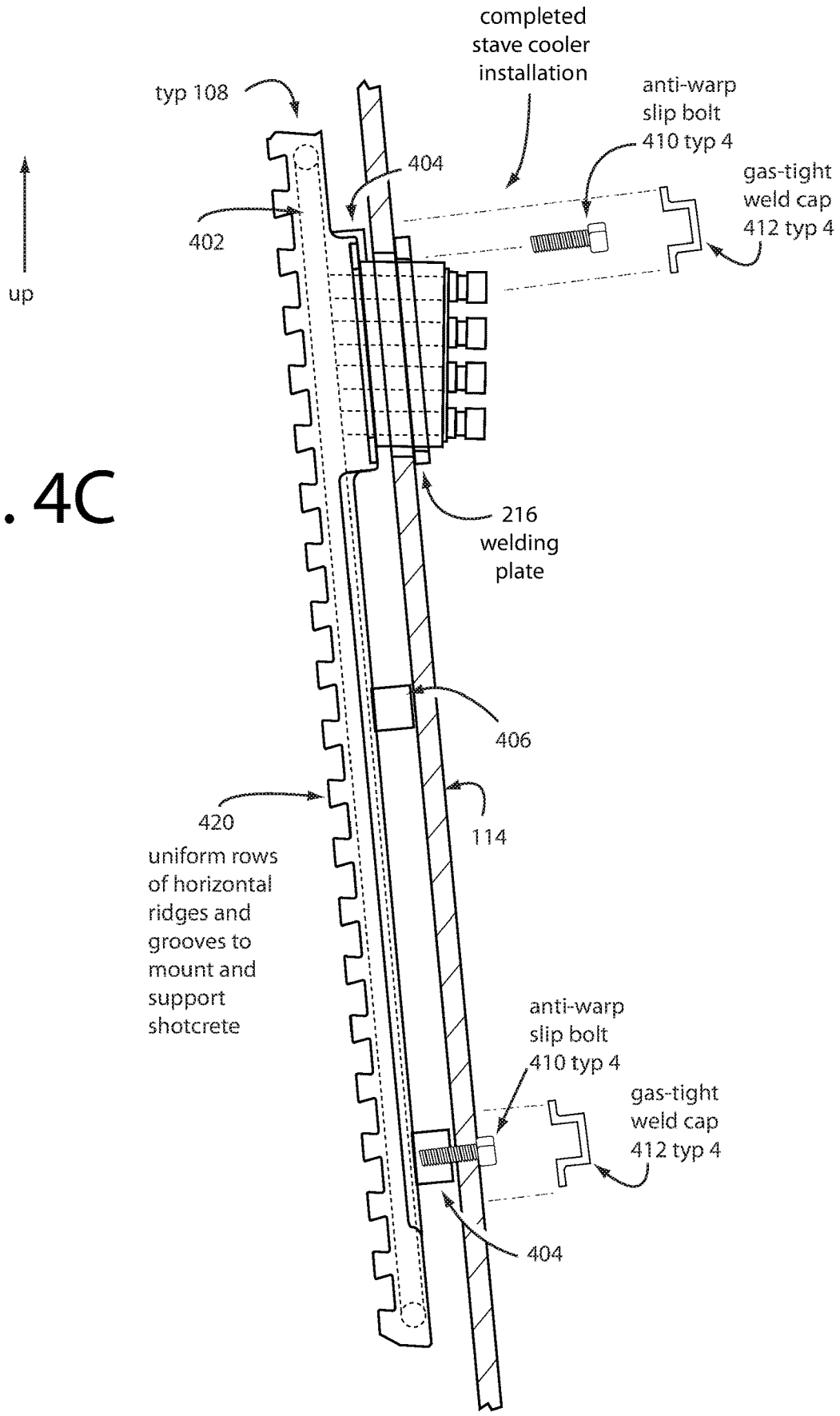
FIG. 4C is a cross sectional view diagram of the finished stave casting of FIG. 4B and how the stave assembles further and mounts to the blast furnace shell to hang on by the pipe "stuffing" box. Bolts in the four corners are used for the initial installation of the stave cooler, and to hold the stave cooler in place against the inside of the blast furnace shell.

FIG. 4C assembles the finished stave casting 128 of FIG. 4B further to mount to the blast furnace shell 114 to hang on by the pipe "stuffing" box 210. In FIGS. 4B and 4C, slip bolts 404 in the four corners are threaded into helicoil insertable threads or stainless steel cast-in insert to help keep the stave cooler 108 tight against the blast furnace shell. A stuffing material 406 is packed, poured, cast, or otherwise used to fill the insides of pipe "stuffing" box 210 so heat can be carried away by the coolants circulating through pipe inlets/outlets 206. Suitable materials for this purpose abound, but they must be flexible and able to tolerate high temperatures.

Figure 5A:
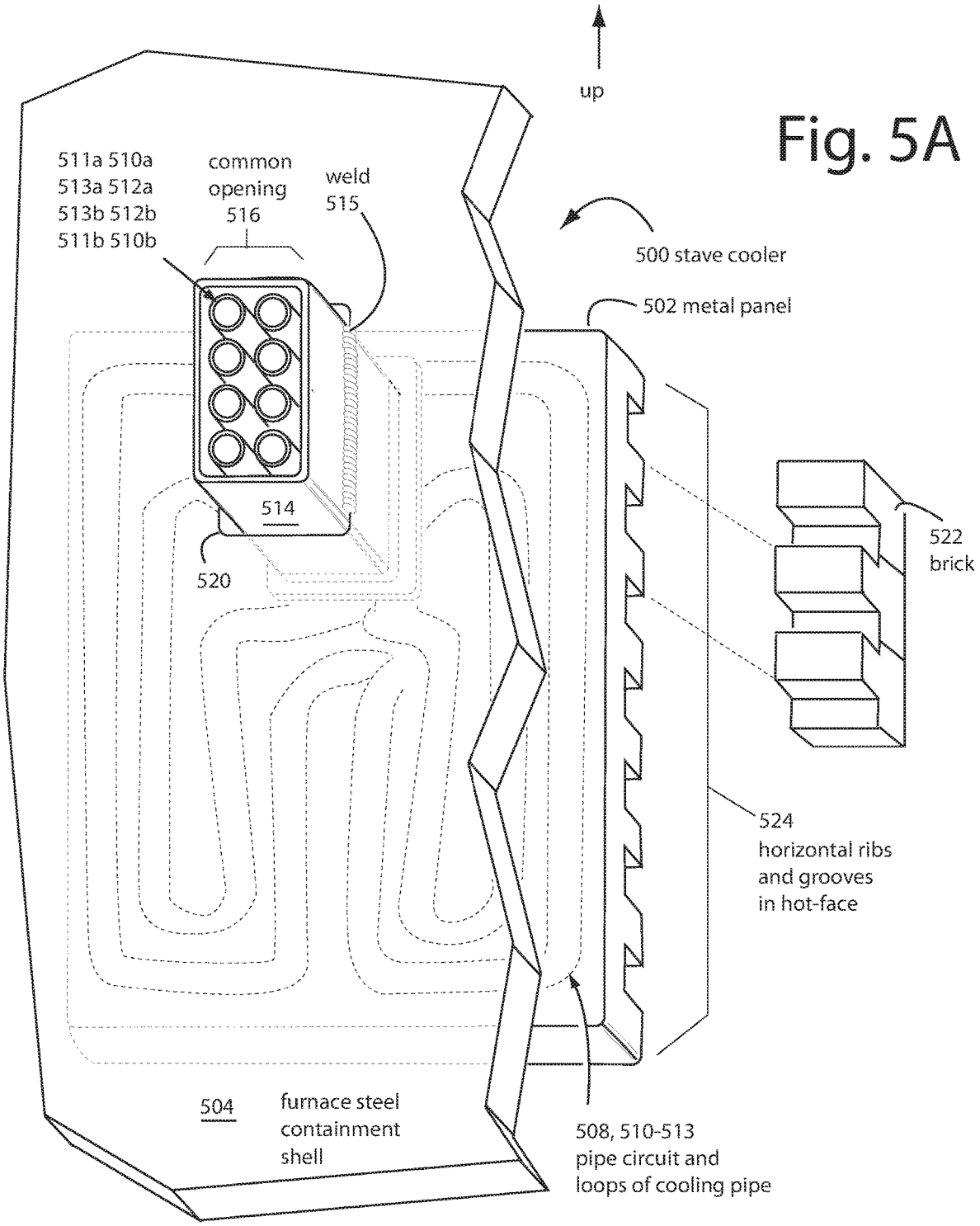
FIG. 5A is a perspective view diagram of a stave cooler with a single pipe box hung on and supported by a single matching penetration for it in a blast furnace shell. Horizontal grooves are provided to retain refractory brick. The pipe box can be welded to the blast furnace shell in a continuous gas-tight seal if the gaps inside the penetration are minimal, otherwise an adapter plate will be needed.

FIG. 5A represents a stave cooler 500 and metal panel 502 installed inside and onto a blast furnace shell 504. A pipe circuit 508 is fully disposed inside metal panel 502 and includes four loops of piping 510-513. These respectively are brought out together in a single group as inlet/outlet ends

Figure 5B:
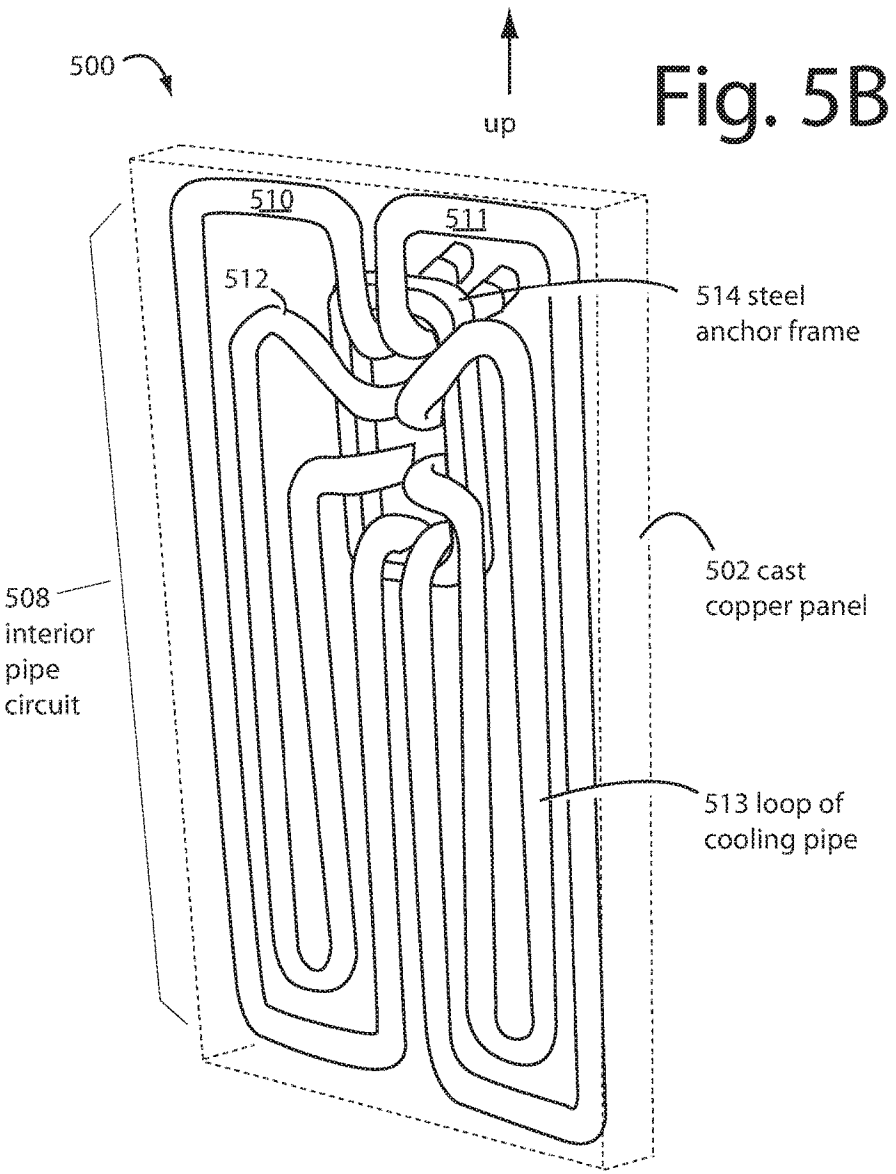
FIGS. 5B and 5C are side view and perspective view diagrams of the pipe circuit internal to the stave cooler panel of FIG. 5A.
Figure 5C:
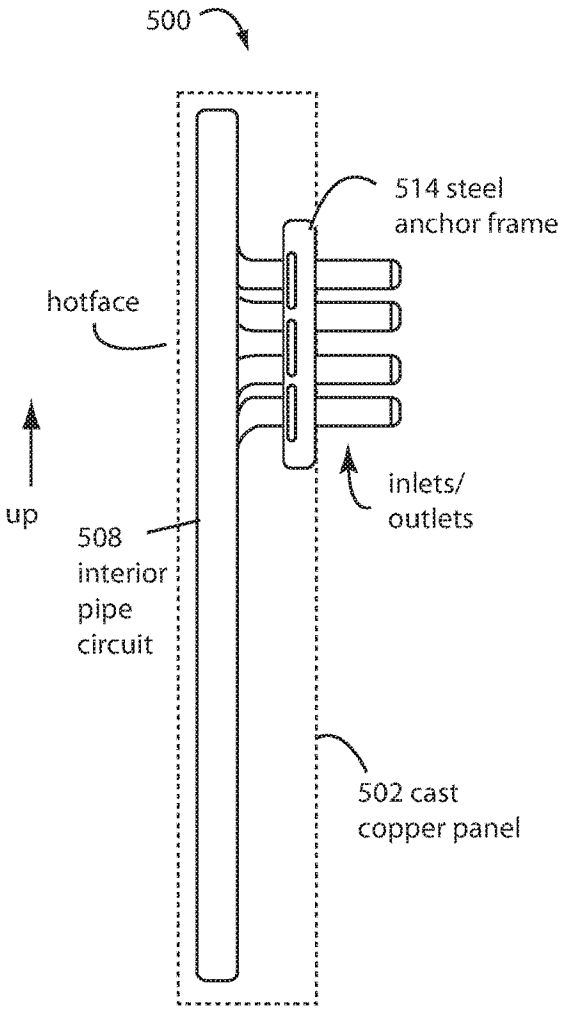

510*a*, 510*b*, 511*a*, 511*b*, 512*a*, 512*b*, 513*a*, and 513*b*. All these pass through inside a single pipe box 514. Such fits inside an is hung on and supported by a single matching penetration 520 provided for it in blast furnace shell 504. Horizontal grooves 524 are provided to retain refractory brick or shotcrete. The pipe box 514 can be welded directly to the blast furnace shell 504, as shown here, in a continuous gas-tight seal if the gaps inside the penetration 520 are minimal, otherwise an adapter plate will be needed. FIGS. 5B and 5C represent how pipe circuit 508 lays flat internal to the stave cooler panel 502 of FIG. 5A. These FIGS. 5B and 5C clearly show a steel anchor frame 514 that is cast flush into one face of the stave cooler panel 502 in a ring around all the single group of inlet/outlet ends 510*a*, 510*b*, 511*a*, 511*b*, 512*a*, 512*b*, 513*a*, and 513*b*.

Alternatively, steel anchor frame 514 is welded in with solid state welding technology to achieve very strong, gas-tight bonds with the copper casting. Solid-state welding is defined as a joining process without any liquid or vapor phase, with the use of pressure, and with or without increased temperature. Solid-state welding generally refers to a coalescence that results from the intense application of pressure alone or a combination of heat and pressure. When heat is used, the temperature in the process is kept below the melting point of the metals being welded. No filler metal is used. Representative welding processes include: diffusion welding where two surfaces are held together under pressure at an elevated temperature and the parts coalesce by solid-state diffusion; friction welding where coalescence is achieved by the heat of friction between two surfaces; and, ultrasonic welding where moderate pressure is applied between two parts and an oscillating motion at ultrasonic frequencies is used in a direction parallel to the contacting surfaces. The combination of normal and vibratory forces results in shear stresses intense enough to push aside surface films and produce atomic bonding of the two surfaces.

Figure 6B:
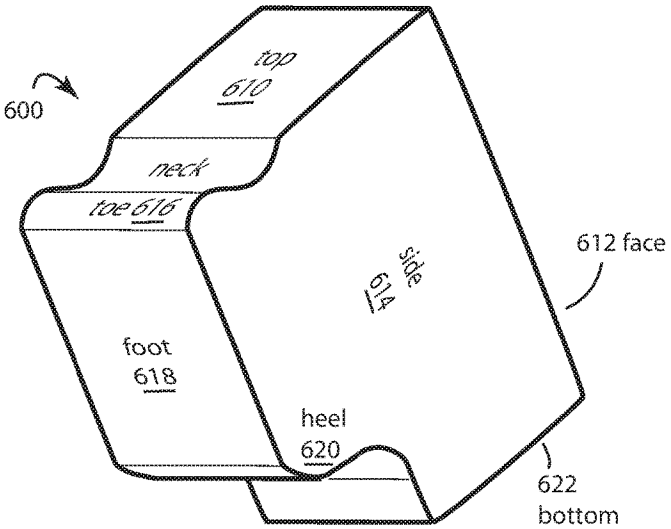
FIGS. 6A and 6B are perspective view diagrams of the horizontal ribbing, and channeling that can be machined or molded into the hotface of any stave cooler herein to retain the brick of FIG. 6B.
Figure 6A:
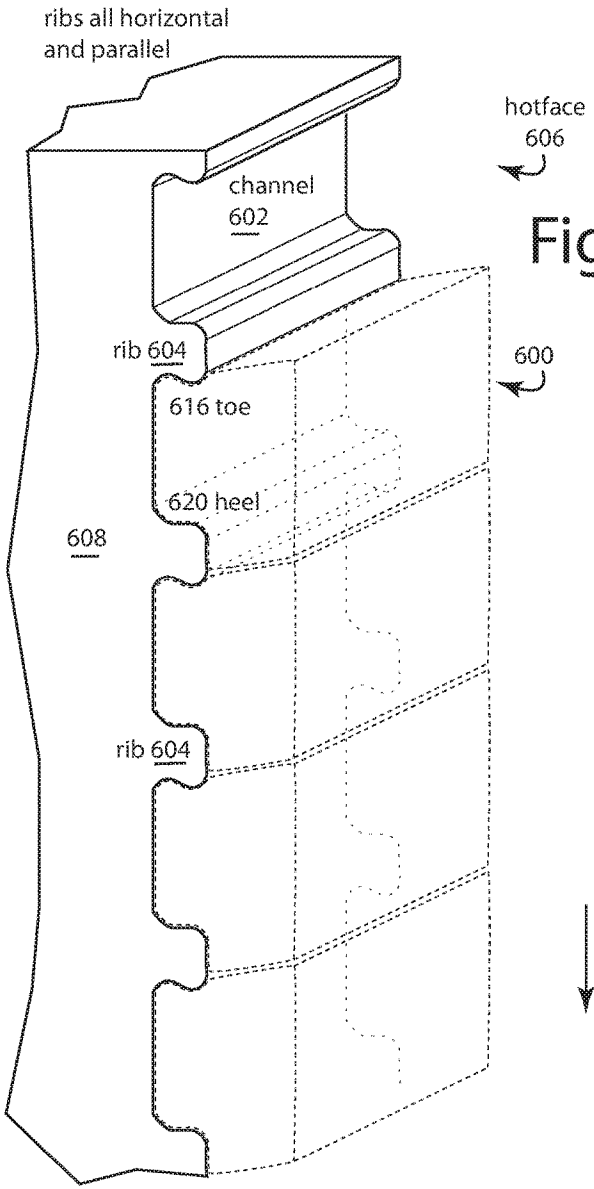

FIGS. 6A and 6B represent a refractory brick 600 pressed into a shape that can be locked into or retained in horizontal channels 602 between parallel ribs 604 in the hotface 606 of a copper stave cooler 608. Brick 600 has a flat top 610, a flat face 612, flat parallel sides 614, a toe 616, a foot 618, a rounded heel 620, and a flat bottom 622. The general arrangement is such that the ribs must be horizontal and vertical to one another so the bricks can be properly retained in earth's gravity. Ideally, gravity assists in the retention. The internal process flow of materials inside BF 100 is generally down, however it is highly wearing, e.g., abrasive, adhesive, erosive, and corrosive. Not to mention hot enough to melt or vaporize most materials. Water coming into contact with it can be powerfully explosive. See our parent application to this one about RICH GLYCOL, US Published Patent Application 2018-0245171 on Aug. 30, 2018.

The life and performance of bricks 600 will be severely curtailed if they do not stay in intimate contact with stave cooler hotface 606 to receive cooling. Gaps, cracks, and spalling can cause excessive heating. It helps if bricks 600 form a tight enough complete horizontal ring row around the inside of BF 100 that they will swell and expand side-to-side enough to press the feet 618 harder into channels 602. A proper selection of materials for brick 600 is therefore required to get an appropriate amount of expansion without crushing or cracking.

Figure 7:
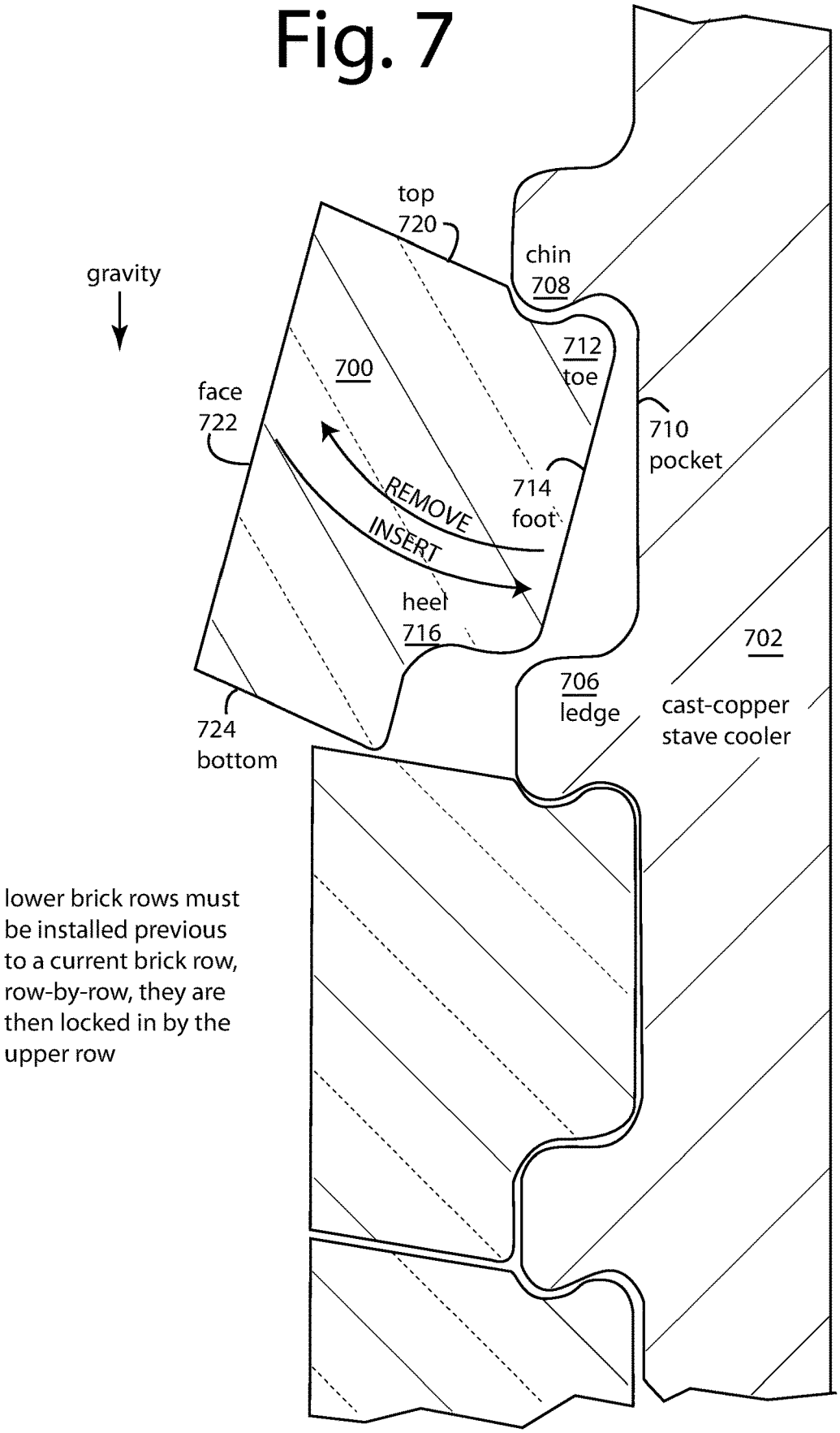
FIG. 7 is a cross sectional diagram of a particular variety of horizontal ribbing, and channeling that can be machined or molded into the hotface of any stave cooler herein to retain a form of gravity like that of FIG. 6B.

FIG. 7 represents a rotate-in-to-lock refractory brick 700. Such are press molded to rather tight dimensional tolerances using silicon carbide or graphite. For example, ±0.0625 inches. We described these in our parent applications to this one as early as 2009. These rotate-in-to-lock refractory bricks 700 require a matching contoured hotface on a copper stave cooler 702. Regular rows of ledges 706 with chins 708 span down over a flat pocket 710 to the next ledge 706 below. The matching bricks 700 include a toe 712 that tucks under each chin 708 and is rotated down with a foot 714 into the matching pocket 710 until a heel 716 settles onto the ledge 706. The brick 700 has a flat top 720, a slightly horizontally concave face 722, and a flat bottom 724. A typical brick 700 is about a cubic foot in volume.

The rotate-in-to-lock refractory brick 700 will not function correctly if not used a correct relative orientation to earth's gravity. FIG. 7 shows the correct relative orientation to earth's gravity with the "gravity" arrow pointing down.

Bricks 700 must be installed in complete horizontal ring rows around the interior of BF 100 before proceeding to a next upper row. Any brick installed in a row above would prevent the top 720 from rotating up because it would contact and be stopped by the bottom 724 of the brick above.

Figure 8:
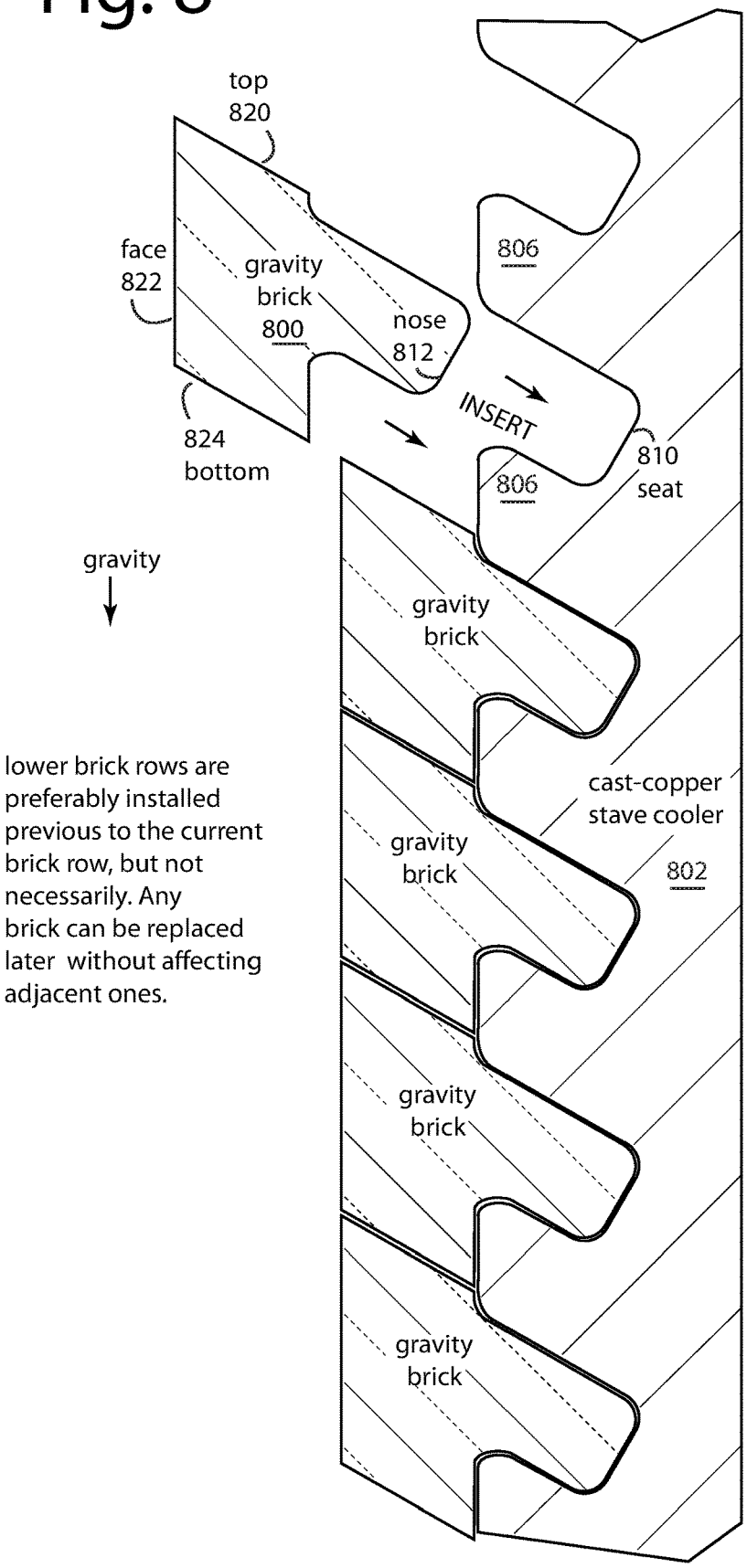
FIG. 8 is a cross sectional diagram of a further particular variety of horizontal ribbing, and channeling that can be machined or molded into the hotface of any stave cooler herein to retain a form of gravity like that of FIG. 6B.

FIG. 8 represents a refractory "gravity" brick 800. Such are molded to ordinary dimensional tolerances using silicon carbide or graphite. These refractory gravity bricks 800 also require a matching contoured hotface on a copper stave cooler 802. Regular rows of upturned ribs 806 span down over a flat seat 810 to the next rib 806 below. The matching bricks 800 include a nose 812 that inserts into each seat 810 until it hits the seat's bottom. The brick 800 has a stepped top 820, a slightly horizontally concave face 822, and a flat bottom 824. A typical brick 800 is about a cubic foot in volume.

The refractory gravity brick 800 will function best if used in a relative orientation to earth's gravity that helps it constantly press its nose 812 deeper into the matching seat 810 as it swells, ages, deteriorates, and shifts over extended periods of operational time. FIG. 8 shows an acceptable relative orientation to earth's gravity with the "gravity" arrow pointing down.

Bricks 800 are preferred to be installed in complete horizontal ring rows around the interior of BF 100 before proceeding to a next upper row. Any brick 800 installed adjacent to any other brick 800 will not prevent the removal of a damaged brick nor the insertion of a new brick thanks to the favorable geometries.

"Bricks" made of cast iron could be shaped like bricks 700 and 800 and be usefully applied.

The weight of every brick 700 or 800 is pretty much carried by their respective stave coolers 702 and 802 because they each fully rest on the horizontal rows of ledges 706 and upturned ribs 806. This means that wear that thins the bricks from their faces can be allowed to continue years longer because the bricks don't have to support any brickwork above. Sudden collapse is not a problem.

No doubt variations and modifications to the above will occur to artisans that have read and understood our disclosures here. Such variations and modifications are intended to be included in the scope of the Claims that follow.

The invention claimed is:

1. A stave cooler for supporting and cooling refractory in a pyrometallurgical furnace, comprising:

an outer metal panel housing comprising a pure copper casting;

an inner cooling fluid circuit comprising a cooling fluid inlet, a cooling fluid outlet and one or more cooling fluid pipes or cooling fluid passageways disposed within the outer metal panel housing;

wherein each cooling fluid pipe and/or passageway enables cooling fluid to pass through and between the cooling fluid inlet and outlet; and a single external manifold made of carbon steel and comprising a hollow manifold housing and top plate for receiving couplings, and that is attached to support the weight of the stave cooler inside on a blast furnace shell;

wherein the single manifold has one or more inlet pipes, or defines one or more inlet passageways, for providing cooling fluid to the cooling fluid inlet of the cooling fluid circuit of the outer metal panel housing; and wherein the single manifold has one or more outlet pipes, or defines one or more outlet passageways, able to receive cooling fluid from the cooling fluid outlet and cooling fluid circuit in the outer metal panel housing;

wherein, all the cooling fluid inlets and outlets are gathered together inside the single external manifold for external coolant connection outside the blast furnace shell.

2. The stave cooler of claim 1, wherein:

the outer metal panel housing is configured for installation between the inside of a blast furnace containment shell and any inner liner;

the cooling fluid pipes and/or passageways are fully disposed within the outer metal panel housing and include at least one individual and mechanically independent loop of a pipe or a passageway each with an inlet end and an outlet end for a circulating liquid coolant passed externally through the blast furnace containment shell;

the manifold comprises a metal collar with a perimeter wall attached at one end to the outer metal panel housing and extending in height away from the metal panel enough to fully penetrate the thickness of the blast furnace containment shell; and a single opening within the metal collar through which all inlet and outlet ends of all independent loops of pipe are gathered to pass their respective parts of the circulating liquid coolant externally gas-tight through a cover plate and the blast furnace containment shell.

3. The stave cooler of claim 1, wherein:

the outer metal panel housing substantially comprises a single copper casting;

the interior pipe circuit is cast within the outer metal panel housing as a pipe or a drilled passageway;

the one end of the metal collar attached to the metal panel is attached by casting and embedding it inside the outer metal panel housing;

the metal collar substantially comprises carbon steel and numbers no more than one per outer metal panel housing; and the metal collar is substantial enough to support the weight and provide gas sealing of the stave cooler when mounted within and through a matching single penetration of the blast furnace containment shell.

4. The stave cooler of claim 2, wherein:

the inner liner substantially comprises individual and essentially identical refractory bricks tightly mounted, locked together, and in thermal contact within horizontal rows on a hot-face of the metal panel;

wherein a complete inner liner for the blast furnace is assembled from rows of a sufficient number of stave coolers positioned and stacked to form a complete cylindrical wall of cooled refractory brick lining within the blast furnace containment shell.

5. The stave cooler of claim 4, wherein:

the metal panel and its horizontal rows on a hot-face are cylindrically curved; and the individual and essentially identical refractory bricks are sized and in sufficient number to more tightly press themselves together shoulder-to-shoulder as they swell under any blast furnace heat, and thereby improve refractory brick cooling by a resulting higher contact pressure and closing of gaps and cracks with each hot-face of a corresponding stave cooler.

6. The stave cooler of claim 5, wherein:

the metal collar protrudes from one face of the stave cooler and is partially cast as part of the stave, welded or brazed to the stave, or attached to the stave with fasteners.

7. The stave cooler of claim 5, wherein:

the cooling fluid is pumped through under pressure from an external pump and comprises an intrinsically-safe-from-BLEVE desiccating rich glycol mixture of glycol alcohol and a lesser amount of water and corrosion inhibitors.

8. A stave cooler, comprising:

a cast copper stave cooler body panel that has disposed therein a circuit of water pipes with a number of loops each with an inlet end and an outlet end, and all the inlet ends and outlet ends clustered together in a single group that exits a backside of the copper stave cooler body panel;

a steel anchor frame roughly in the shape of a flat, thick O-ring that surrounds the inlet ends and outlet ends clustered together and set in cast copper flush at the surface at the exit on the backside;

a series of footer openings placed around a lower embedded perimeter of the steel anchor frame that are entrained with copper that froze inside during a copper casting of the stave cooler body panel, wherein the steel anchor frame is thereby mechanically locked into the cast copper stave cooler body panel;

a pipe collection box made of steel, hollow, open at two opposite ends, and one end continuously welded along its entire perimeter to a top exposed face perimeter of the steel anchor frame, wherein all the inlet ends and outlet ends clustered together are passed through inside for external connections of circulating liquid coolants;

wherein, the entire stave cooler is fully supportable inside a blast furnace by the pipe collection box.

9. The stave cooler of claim 8, further comprising:

a wear-resistance barrier set into a front-side hotface of the cast copper stave cooler body panel that includes horizontal rows of ribs and channels in the panel to retain bricks of silicon carbide, graphite, or cast iron on the surface that each independently lock into or are otherwise supported during use to form an inner refractory liner of the blast furnace, and that as a group require a particular orientation with respect to earth's gravity to function.

10. The stave cooler of claim 8, wherein:

each brick is shaped to have a toe that must be brought under a chin of each rib during installation, and the whole then rotated with the assistance of earth's gravity into the channel where it thereby locks itself in at the top and locks in a brick in a row below it by the bottom and stays put on its own because of the direction of pull of earth's gravity.

11. The stave cooler of claim 8, wherein:

each brick is shaped to have a nose that must be inserted down and out during its installation into a inwardly and upwardly turned seat between upwardly turned horizontal and parallel ribs and is assisted by earth's gravity to keep the nose settled into the seat.

12. A pipe collection box and stave support for a cast copper stave cooler body panel that has disposed therein a circuit of water pipes with a number of loops each with an inlet end and an outlet end, and all such inlet ends and outlet ends clustered together in a single group that exits a backside of the copper stave cooler body panel, comprising:

a steel anchor frame roughly in the shape of a flat, thick O-ring that surrounds the inlet ends and outlet ends clustered together and set in cast copper flush at the surface at the exit on the backside;

a series of footer openings placed around a lower embedded perimeter of the steel anchor frame that are entrained with copper that froze inside during a copper casting of the stave cooler body panel, wherein the steel anchor frame is thereby mechanically locked into the cast copper stave cooler body panel;

a pipe collection box made of steel, hollow, open at two opposite ends, and one end continuously welded along its entire perimeter to a top exposed face perimeter of the steel anchor frame, wherein all the inlet ends and outlet ends clustered together are passed through inside for external connections of circulating liquid coolants;

wherein, an entire stave cooler is fully supportable inside a blast furnace by the pipe collection box.

13. The pipe collection box and stave support of claim 12, further comprising:

a top plate fitted to a distal end of the pipe collection box and individually thimbled to each of all the inlet ends and outlet ends and gas-tight so as to fully contain and prevent the escape of any blast furnace process gases.

* * * * *